United States Patent [19]

Moritz

[11] 4,286,817

[45] Sep. 1, 1981

[54] HOISTING ACCESSORY

[76] Inventor: Kjell F. Moritz, Skördevägen 52, S-230 52 Skanör, Sweden

[21] Appl. No.: 104,631

[22] Filed: Dec. 17, 1979

[30] Foreign Application Priority Data

Dec. 21, 1978 [SE] Sweden ..... 7813163

[51] Int. Cl.[3] ..... B66C 1/10

[52] U.S. Cl. ..... 294/67 AA

[58] Field of Search ..... 294/67 R, 67 A, 67 AA, 294/67 AB, 81 R; 212/195–198

[56] References Cited

U.S. PATENT DOCUMENTS

| | | | |
|---|---|---|---|
| 3,572,803 | 3/1971 | Pompe | 294/67 R X |
| 3,675,961 | 7/1972 | Wheeler | 294/67 R |
| 3,879,077 | 4/1975 | Celio | 294/67 R |
| 4,017,109 | 4/1977 | Belinsky | 294/67 AA |

FOREIGN PATENT DOCUMENTS

| | | | |
|---|---|---|---|
| 540799 | 1/1977 | U.S.S.R. | 294/67 AA |
| 623810 | 8/1978 | U.S.S.R. | 294/67 AA |
| 627055 | 8/1978 | U.S.S.R. | 294/67 AA |

*Primary Examiner*—Johnny D. Cherry
*Attorney, Agent, or Firm*—Ladas & Parry

[57] ABSTRACT

A hoisting accessory to be connected to a hoisting device for facilitating the placing of a load through openings in walls and the like. The accessory has a support arm (10), at one end of which a load coupling unit (11) is provided for carrying a load. At its other end the support arm (10) has a counterweight (20) including a suspension unit (22) extending downwards from the support arm and along which a movable unit (23) is displaceable under action of gravity from a retracted position to an extended position. Between the ends of the support arm (10) there is a lift yoke (30) for connection to the hoisting device. A releasable locking device (50) prevents the movable unit (23) from moving. An actuator (19, 15; 63) is provided to release the locking device in response to charging of the load coupling unit (11). In a preferred embodiment the actuator is adjustable.

12 Claims, 16 Drawing Figures

FIG. 1
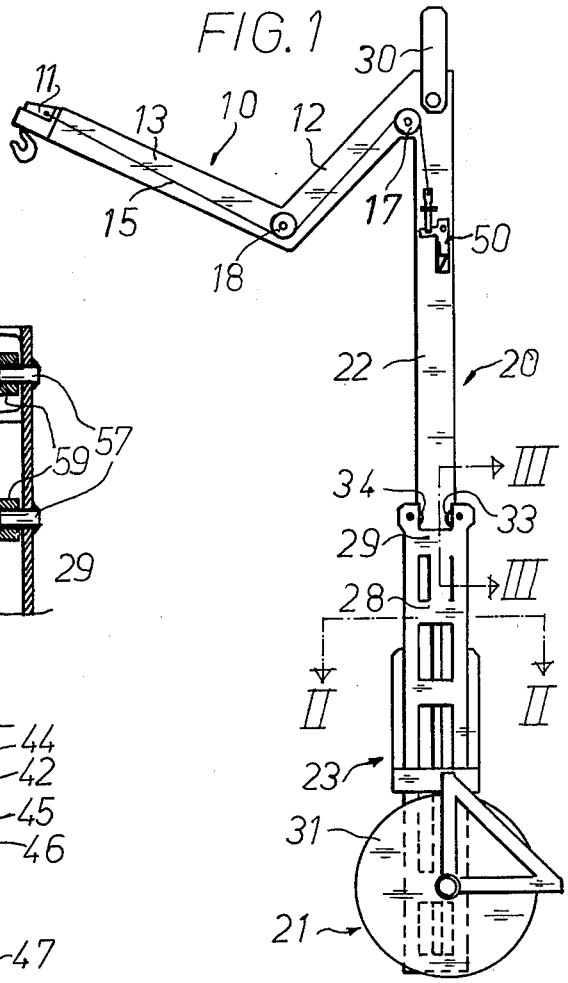
FIG. 3
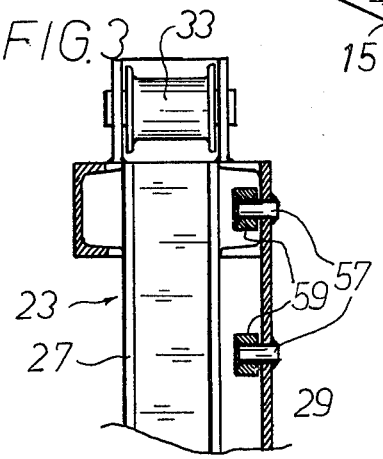
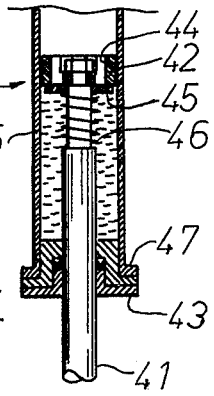
FIG. 4
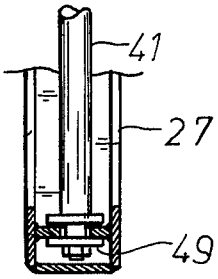
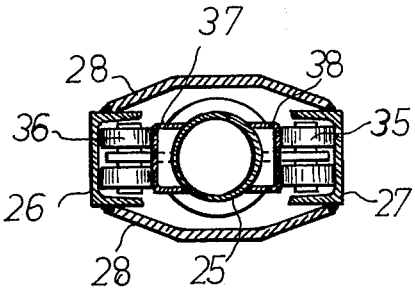
FIG. 2

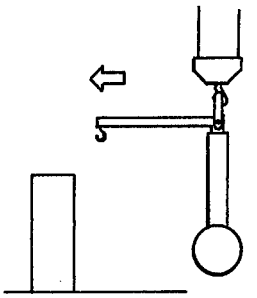
FIG. 8-1
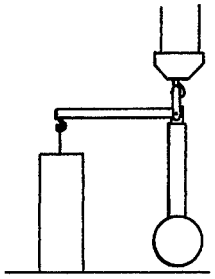
FIG. 8-2
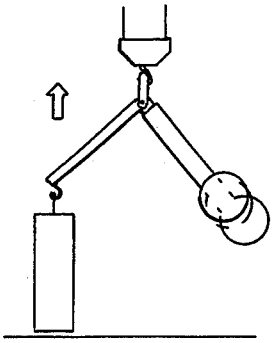
FIG. 8-3
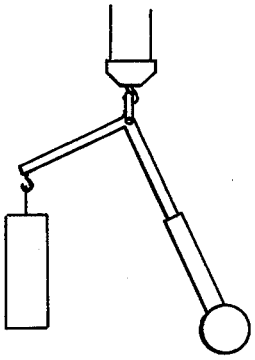
FIG. 8-4
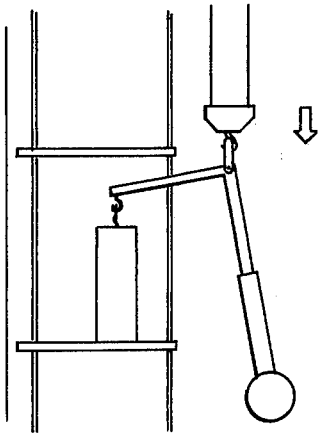
FIG. 8-5
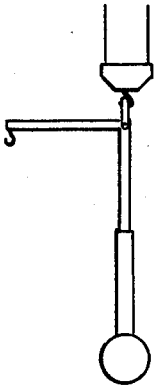
FIG. 8-6
FIG. 8-7
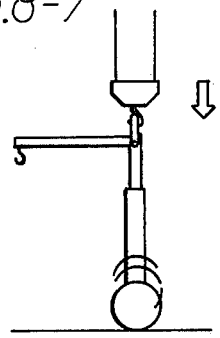

HOISTING ACCESSORY

BACKGROUND AND SUMMARY OF THE INVENTION

The present invention relates to hoisting accessories and more specifically refers to a hoisting accessory for cooperation with a hoisting device, for facilitating the placing of a load through openings in walls and the like, said accessory including a support arm having a load coupling unit at one end for carrying the load unit and at its other end a counter weight means which includes a suspension unit fixed to the support arm, and a movable unit which is movable along the suspension unit, said support arm having a lift yoke for connecting said accessory to the hoisting device.

Such accessories are previously known and facilitate, for instance in the erection of buildings, the placing of a load through narrow openings without being obstructed by overhead scaffold ledges or storeys which are a hindrance to the lateral movement of the hoist cable of the hoisting device. U.S. Pat. No. 3,675,961 discloses an accessory of this kind which has an elongate support arm for horizontal suspension when using said accessory. By means of an electric motor a counterweight is displaceable along the horizontal support arm.

However, this and similar prior hoisting accessories are bulky. Moreover, for the displacement of the counterweight some kind of separately energized drive means is required. Said drive means is a source of unreliability as to the function of the accessories and adds to complexity and cost.

An object of the invention is to provide a hoisting accessory for cooperation with a hoisting device, for facilitating the placing of a load through openings in walls and the like, which accessory is simple and moreover does not require any drive means for its operation.

This object is achieved by means of a hoisting accessory to be used in cooperation with a hoisting device for facilitating placing of a load through openings in walls or similar, said accessory having a support arm having at one end a load coupling unit for carrying a load, and at its other end counteweight means which includes a suspension unit connected to the support arm, and a movable unit displaceable along the suspension unit, which movable unit carries the proper counterweight, the support arm having between its ends a lift yoke for connection to said hoisting device. According to the invention said hoisting accessory is characterized in that the suspension unit of said counterweight means from the support arm extends downwards in order to permit, under influence of gravity, displacement of the movable unit along the suspension unit from a retracted position to an extended position, and that a locking device which is releasable in response to loading of the load coupling unit is provided to prevent mutual movement between the suspension unit and the movable unit.

The hoisting accessory according to the invention operates automatically, the movable unit carrying the counterweight being arranged for automatic displacement to the extended position when a load is lifted by the load coupling unit of the support arm, and said movable unit being automatically retractable into the retracted position when said accessory is lowered to rest on a bed, such as the ground.

DESCRIPTION OF THE DRAWINGS

In the accompanying drawings, which form a part of the specification and are to be read in conjunction therewith, and in which like reference numerals are used to indicate like parts in the various views:

FIG. 1 is a side elevational view of a preferred embodiment of the hoisting accessory according to the invention, showing the movable unit of the counterweight means in an intermediary position between a retracted and an extended position;

FIG. 2 is an enlarged cross-sectional view of the counterweight means of the accessory illustrated in FIG. 1, said view being taken along line II—II in FIG. 1;

FIG. 3 is an enlarged fragmentary cross sectional view of the counterweight means in FIG. 1, said view being taken along line III—III in FIG. 1 and illustrating the upper portion of the movable unit and an upper guide roller;

FIG. 4 is an enlarged broken sectional view of a shock absorber of the counterweight means;

FIGS. 8-1 to 8-7 schematically illustrate an operational cycle for the hoisting accessory, the support arm being shown with a modified design;

DETAILED DESCRIPTION OF CERTAIN PREFERRED EMBODIMENTS

Figure 5:
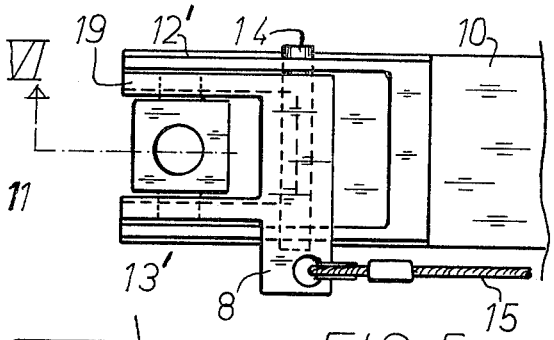
FIG. 5 is a fragmentary top elevational view illustrating the distal portion of the support arm and showing the load coupling unit thereon.

FIG. 1 shows a preferred embodiment of the hoisting accessory according to the invention and in a position when suspended in a hoist cable of a hoisting device. Said accessory has a support arm 10, at one end of which a counterweight means 20 is located. Said counterweight means 20 has a suspension unit 22 fixed to support arm 10 and extending downwards therefrom, along which unit a movable unit 23 carrying the counterweight 21 proper is displaceable under influence of gravity from a retracted position, where movable unit 23 is located close to support arm 10, and an extended position, where movable unit 23 is located at a larger distance from support arm 10. A lift yoke 30 is preferably pivotably fixed to the combined support arm 10 and said counterweight means 20, and more specifically at a position between the ends of support arm 10.

Suspension unit 22 is arranged at an angle to support arm 10, viz. a straight line through the distal end of the support arm and the pivot of lift yoke 30. In FIG. 1 suspension unit 22 is shown as a straight member at a right angle to said straight line. However, said angle can exceed 90° as long as the suspension unit 22 and movable unit 23 carried thereby do not swing above a horizontal line when the intended load is carried by load coupling unit 11. Moreover, suspension unit 22 can be curved in the plane of FIG. 1, movable unit 23 having a corresponding curve.

For the sake of clearness said accessory is shown in FIG. 1 with movable unit 23 in an intermediary position between the retracted position and the extended position. At the distal end of the support arm a load coupling unit 11 is provided for carrying a load. This unit is movably supported between two end positions, viz. a first uncharged position (as shown in dot and dash lines in FIG. 6) and a second charged position which is shown in solid lines in FIG. 6. A releasable locking device 50 (FIG. 7) biased into a locking position is provided on suspension unit 22 for preventing movable unit 23 from moving from the retracted position to the extended position. Locking device 50 is arranged to release movable unit 23 in response to charging of load coupling unit 11. For this purpose a connection member 15 is arranged between load coupling unit 11 and locking device 50, said connection member transmitting the movement of the load coupling unit to the locking device for releasing the same when the coupling unit is switched over into charged position.

Figure 7:
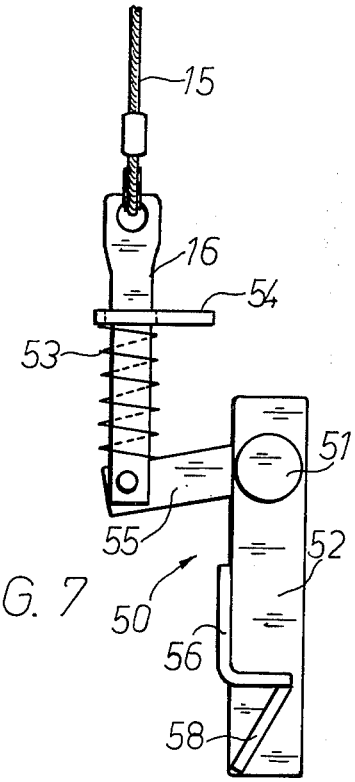
FIG. 7 is an enlarged fragmentary view of the locking device of the counterweight means illustrated in FIG. 1.

Before describing the hoisting accessory in detail its operation will be briefly presented with reference to FIGS. 8-1 to 8-7 which figures schematically show said accessory provided with a straight support arm 10.

Figure 6:
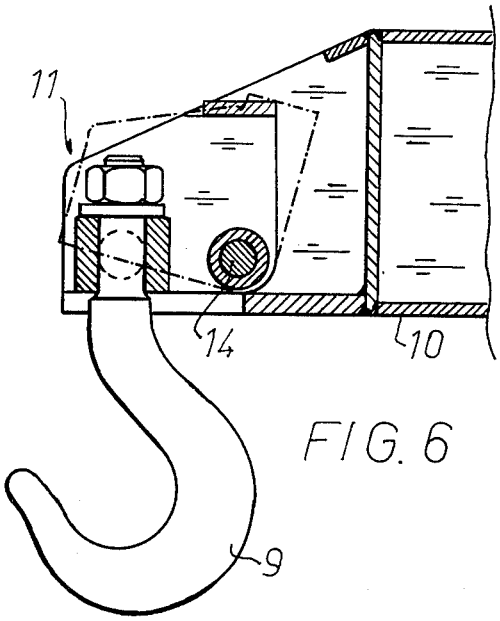
FIG. 6 is a sectional view of the distal portion of the support arm, taken along line VI—VI in FIG. 5.

In FIG. 8-1 the hoisting accessory is shown suspended by means of a hoist cable and being moved laterally towards a load. Said accessory is moved in the direction of the arrow such that the load coupling unit of the support arm is placed over the load. In FIG. 8-2 the load coupling unit is connected to the load but is only slightly charged. When, as shown in FIG. 8-3, said accessory together with the load is hoisted upwards the support arm will, under action of the weight of the load, turn downwards and said counterweight means will turn upwards. Since the charging of the load coupling unit results in a switching of the latter into its second charged position the locking device will, by intermediary of said connection member, open to releae the movable unit. Then, as indicated in FIG. 8-3, the movable unit of said counterweight means will be displaced towards the extended position. In FIG. 8-4 the movable unit is shown in its extended position, the support arm under action of the torque of the extended counterweight has been turned back in a direction towards the horizontal position. In FIG. 8-5 it is shown how the load has been placed by means of the support arm in an opening on a scaffold floor and how said accessory is lowered for releasing the load from the load coupling unit. In FIG. 8-6 said accessory is shown hanging freely after the load has been disconnected, the movable unit of the counterweight means still being extended. Since the load coupling unit is not charged, the locking device will now have taken its locking position. In FIG. 8-7 it is shown how the counterweight means in lowering said accessory is applied against a bed, e.g. the ground, the movable unit being displaced along the suspension unit back to its retracted position for being locked there by means of said locking device.

Contrary to the embodiments of the accessory shown in FIG. 8 the accessory according to FIG. 1 has a support arm 10 having a goose-neck shape, the support arm having an inner segment 12 extending downwards and an outer segment 13 extending upwards. The embodiment according to FIG. 1 gives the further advantage that said counterweight means with one and the same structure permits the placing of a load having a greater vertical extension into one and the same opening.

In the preferred embodiment of said accessory, suspension unit 22 of said counterweight device comprises a leg which, when said accessory is suspended in a hoist cable and is in its unloaded position, extends substantially in vertical direction downwards.

Leg 22 is comprised of an elongate pipe 25 (FIGS. 2 and 4) between diametrically opposed U-channel members 37, 38, the flanges or legs of which are facing pipe 25 and are attached thereto.

Movable unit 23 is structured as a frame having two laterally spaced U-channel members 26, 27 which extend in the direction of leg 22. Transversal plate members which are shown at 28 and 29 connect members 26, 27 which have their flanges or legs facing inwards. Between U-channel members 26, 27 a space is formed for receiving leg 22.

On both sides of the frame the counterweight in the form of circular concrete blocks 31 is carried by means of lateral beams which are strengthened by inclined beams.

At the upper portion of the frame, opposite upper guide rollers 33, 34 are rotatably supported on the frame. These guide rollers cooperate with the longitudinal U-channel members 37, 38 on leg 22.

Moreover, at the lower end of leg 22 opposite pairs of guide rollers 35, 36 are arranged for cooperation with U-channel members 26, 27 of the frame.

Said guide rollers from together with the U-channel members of the leg and the frame a guiding device which prevents the movable unit from rotating around leg 22, which, as stated below, is required for the correct operation of the locking device.

Referring to FIG. 4 said counterweight means is shown to have a shock absorber for damping the movement of the frame when being extended. At its lower-free end pipe 25 has a seal 43 with a central opening through which a piston rod 41 is displaceable. The lower end of piston rod 41 is fixed to the frame at 49 (FIG. 4). A piston 42 is fixed to the upper end of piston rod 41 within pipe 25 and is movable in the pipe. Consequently, pipe 25 is a cylinder in a cylinder-piston assembly (25, 42), which serves as a damper or shock absorber (generally denoted 40) for movable unit 23 of said counterweight means. Pipe 25 is filled with a fluid such as hydraulic oil. For achieving a displacement of the movable unit 23 from the retracted position to the extended position there is a permanently open small passage between the upper and lower end surfaces of piston 42, and so fluid, in by-passing the piston, can flow between the two chambers of the pipe cylinder 25 separated by piston 42. The passage is preferably obtained by a small clearance between the piston and the cylinder. When movable unit 23 is released a predeterminedly controlled movement is achieved.

Moreover, piston 42 has through openings 44, which are closed at the lower piston end surface by means of a closure means shaped as a plate 45. The portion of the piston rod 41 adjacent the piston 42 has a reduced diameter. On this portion a pressure spring 46 is mounted for biasing plate 45 towards the openings 44. Openings 44 and biased plate 45 serve as a non-return valve.

When movable unit 23 moves downwards, plate 45 will close the openings 44 in piston 42 and only a predetermined small by-passing of the fluid is achieved as a result of the clearance of the piston in the cylinder. On the other hand, when, in retracting the movable unit by applying the same against the ground, piston rod 41 and piston 42 are moved upwards, plate 45, at a pressure in the upper chamber in the cylinder determined by the spring force of spring 46, will be displaced on the piston rod away from the piston so that fluid can flow substantially freely from the upper chamber of the cylinder into the lower chamber. In this way the movable unit is returned fairly rapidly to the retracted position. At the lower end of pipe 25 a stop 47 is arranged for cooperation with a complementary shoulder or guide rollers 33, 34 at the upper portion of the frame, thereby defining the extended position of movable unit 23 and preventing further movement.

As shown in FIG. 7 locking device 50 includes a pawl 52 journalled around a pivot 51 fixed to leg 22. Pawl 52 has a joint lever 55. A pressure spring 53 which urges from a fixed member 54 on the suspension unit and against joint lever 55 biases pawl 52 into a locking position. A hook-shaped locking member 56 on the pawl is provided to cooperate with any one of several studs 57 (FIG. 3) positioned in line over each other, which extend towards leg 22 from plate member 29 on the frame. The studs 57 have bushings 59 of a softer material. Pawl 52 also has a guide member 58 comprising a downwardly inclined plate extending from the lower leg of the locking member 56. Since pawl 52 in locking position (FIG. 7) is aligned with studs 57, the studs, when the movble unit is moved towards retracted position, will be applied against guide member 58 and will slide along the same thereby turning the pawl 52 clockwise (FIG. 7) for passing locking member 56. Under action of spring 53, pawl 52 is turned back into its locking position and so locking member 56 of the pawl will catch one stud and retain movable unit 23, when said accessory is subsequently raised. Consequently, movable unit 23 will be locked in the retracted position.

Pressure spring 53 is carried on a pin 16 which passes through an opening in fixed member 54 and is pivotably connected to joint lever 55. Via connection member 15, which here comprises a flexible cable, pin 16 is connected to load coupling unit 11. Guide pulleys 17 and 18 (FIG. 1) are arranged on support arm 10 for guiding cable 15.

As shown in FIGS. 5 and 6 load coupling unit 11 includes a bracket member 19 supported by means of a pivot 14 between legs 12' and 13' of the support arm. A hook 9 is rotatably carried in bracket 19. Pivot 14 is positioned at the lower portion of bracket 19 while a projection 8 is provided at the upper portion of bracket 19 for connection to cable 15.

In FIG. 6 load coupling unit 11 is shown in its second charged position which is defined by lower opposed flanges on legs 12 and 13, against which flanges bracket 19 is applied. When load coupling unit 11 is uncharged or carries little load, pressure spring 53 via cable 15 will maintain the load coupling unit into the first, uncharged position shown in FIG. 6 by dot and dash lines.

Figure 9:
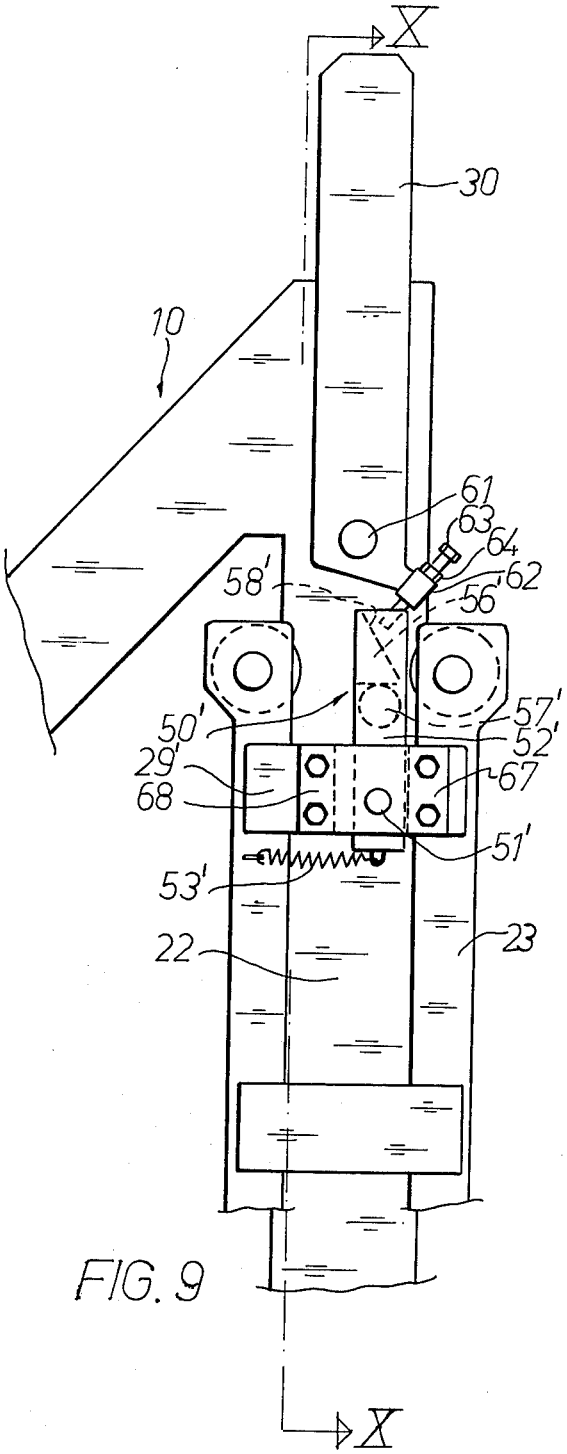
FIG. 9 is an enlarged fragmentary side elevational view of the upper portion of hoisting accessory according to the invention, said view showing the locking device with an alternative structure.
Figure 10:
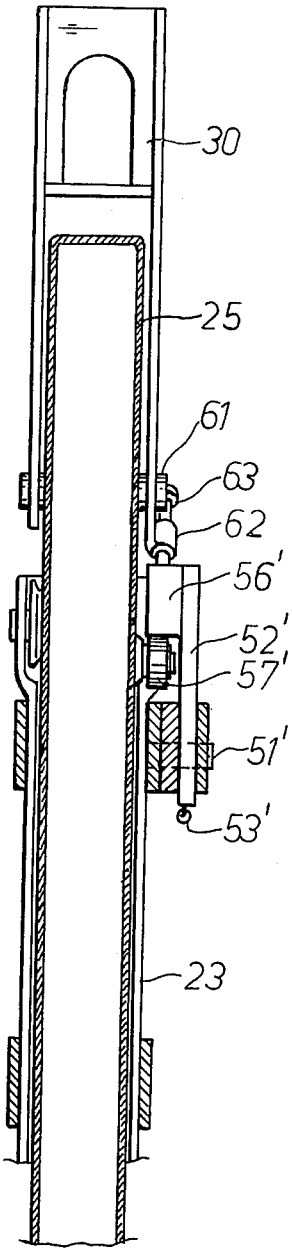
FIG. 10 is a sectional view taken along line X—X in FIG. 9.

FIGS. 9 and 10 which are fragmentary views of the upper portion of the hoisting accessory, illustrate an alternative embodiment of the releasable locking device which prevents said counterweight means from being extended. In this embodiment the load coupling unit need not be pivotable between two positions and no connection is required between the load coupling unit and the locking device either.

In the alternative locking device 50' lift yoke 30 is pivotably connected to suspension unit 22 by means of a pivot 61. Locking device 50' includes a pawl 52' journalled around a pivot 51' on movable unit 23 of counterweight means 20, i.e. on the transversal member 29' between the opposite U-channel members 26, 27. Pivot 51' is perpendicular to the extension of said suspension unit and so pawl 52', as disclosed in FIG. 9, is pivotable laterally across the suspension unit between two end positions which are defined by stop members 67, 68. A tension spring 53' biases pawl 52' into its locking position in which pawl 52'—when said counterweight means is retracted—by means of a hook-shaped locking member 56' catches a stud 57' embodied as a roller projecting from suspension unit 22.

Locking member 56' on pawl 52' has an inclined upper guide surface 58'. When, in returning movable unit 23 from the extended position pawl 52' is moved along leg 22, guide surface 58' is applied against roller 57' which urges pawl 52' anti-clockwise. When locking member 56' has passed roller 57', pawl 52' snaps back under action of spring 53' into locking position and maintains movable unit 23 in its retracted position.

On lift yoke 30 an actuation device is provided for releasing pawl 52' when a predetemined load is carried by coupling unit 11. The actuation device includes a bracket 62 having a threaded through-hole in which a bolt 63 is screwed. Bolt 63 is adjustably fixed by means of a locking nut 64. Bolt 63 is directed obliquely downwards towards guide surface 58' of pawl 52' and has its free end located at an adjustable distance from this surface.

When the load coupling unit of said accessory is charged, support arm 10 will turn around pivot 61 of lift yoke 30 and thereby said counterweight means 20 and pawl 52' thereon will be turned. Consequently, the guide surface 58' on the pawl locking member 56' will be applied against the free end of bolt 63 and the pawl will be pushed out from its locking position and so movable unit 23 is released and will slide along leg 22 into the extended position. It is to be noted that said actuation means can be adjusted by the screwing of bolt 63 downwards or upwards such that the movable unit is released when a desired load is connected to the load coupling unit.

In the embodiments of the hoisting accessory described above said counterweight means 20 is located substantially straight below lift yoke 30. However, it is realized that said counterweight means can be connected to a transversal extension of support arm 10 to the right of lift yoke 30. This will increase the transversal dimension of the hoisting accessory and at the same time the restoring torque of said counterweight means will increase when the movable unit has telescoped into its extended position.

Moreover, several telecoping units connected in series can be used in the hoisting accessory instead of only one telescoping unit as described.

Various modifications of the invention may be effected by persons skilled in the art without departing from the scope and principle thereof as defined in the appended claims.

What is claimed is:

1. A hoisting accessory for use with a hoisting device for placing a load through openings in walls or the like, comprising:

a support arm, having an essentially horizontal portion, an integral essentially vertical portion, and a lift yoke between its ends for connecting to said hoisting device, said horizontal portion including a downwardly inclined portion and an upwardly inclined end portion;

a load coupling unit arranged at the outer end of said horizontal portion for carrying a load;

a counterweight unit arranged at said vertical portion displaceable between an upper retracted position and a lower extended position; and a locking device for locking the counterweight unit in said retracted position and, when the load connected to the load coupling unit exceeds a predetermined weight, releasing said counterweight unit for displacement to said extended position under the influence of gravity.

2. A hoisting accessory according to claim 1, wherein said lift yoke is attached to the support arm at the integral connection between said horizontal portion and said vertical portion.

3. A hoisting accessory according to claim 1, wherein said vertical portion is a guide rail along which said counterweight unit is linearly movable by means of guide rollers arranged between the guide rail and the counterweight unit, said guide rail including an end stop for the counterweight unit.

4. A hoisting accessory according to claim 1, wherein said lift yoke is pivotally connected to said support arm, and said locking device is actuated when said support arm has been turned a predetermined release angle in relation to the lift yoke from its unloaded position, and upon lifting a load, whereupon said counterweight unit is released for displacement to said extended position under the action of gravity.

5. A hoisting accessory according to claim 4, wherein the locking device comprises a pawl and a mating stud, one of which is positioned on said vertical portion and the other of which is positioned on said counterweight unit, said pawl being biased to its position engaging the stud, and said locking device being operated by an actuation means for releasing said counterweight unit.

6. A hoisting accessory according to claim 5, wherein said actuation means is a member mounted on said lift yoke for application against and releasing said pawl when said lift yoke is pivoted in relation to said support arm in response to the lifting of a load.

7. A hoisting accessory according to claim 5, wherein said load coupling unit is movable between a first unloaded position and a second loaded position when the load acting on said load coupling unit exceeds a predetermined weight, whereupon the pawl is released as the load coupling unit moves to its second position.

8. A hoisting accessory according to claim 4, wherein said upwardly inclined end portion, while in said unloaded position, is inclined upwardly to the horizontal by an angle which is half the magnitude of said predetermined release angle.

9. A hoisting accessory for use with a hoisting device for placing a load through openings in walls and the like, comprising:

a support arm having an essentially horizontal portion, an integral essentially vertical portion, and a lift yoke attached between the ends of said support arm, for connection to said hoisting device;

a load coupling unit arranged at the outer end of said horizontal portion for carrying a load;

a counterweight unit arranged at said vertical portion displaceable between an upper retracted position and a lower extended position;

a locking device for locking the counterweight in the retracted position and, when the load connected to the load coupling unit exceeds a predetermined weight, releasing the counterweight unit for displacement to its extended position under the influence of gravity; and a shock absorber for smoothing the movement when the counterweight unit is displaced to its extended position.

10. A hoisting accessory according to claim 9, wherein said shock absorber comprises a cylinder and piston assembly being connected between the vertical portion and the counterweight unit.

11. A hoisting accessory according to claim 10, wherein said vertical portion is a guide rail along which the counterweight unit is linearly movable by means of guide rollers arranged between the guide rail and the counterweight unit.

12. A hoisting accessory according to claim 10, wherein said piston comprises an open by-pass passage for permitting by-pass of fluid from one end of said cylinder to the other end thereof when the counterweight unit is moved from said retracted position to said extended position, and a one-way valve for returning fluid from said other end of the cylinder to said first end thereof when the counterweight unit is returned to its retracted position.

* * * * *